United States Patent [19]

Herrmann

[11] 4,252,882

[45] Feb. 24, 1981

[54] DEVELOPING ELECTROPHOTOGRAPHIC IMAGES USING AQUEOUS INK AND TREATING SMOOTH, HYDROPHOBIC IMAGE SURFACE WITH CLEANING LIQUID

[75] Inventor: Heinz Herrmann, Wiesbaden, Fed. Rep. of Germany

[73] Assignee: Hoechst Aktiengesellschaft, Fed. Rep. of Germany

[21] Appl. No.: 844,472

[22] Filed: Oct. 21, 1977

[30] Foreign Application Priority Data

Oct. 25, 1976 [DE] Fed. Rep. of Germany ..... 2648184

[51] Int. Cl.[3] ..... G03G 9/18

[52] U.S. Cl. ..... 430/117; 134/15; 134/39; 355/15; 430/118; 430/125; 430/126

[58] Field of Search ..... 96/1 LY, 1, 1 TE; 355/3 TR, 1 S; 134/15, 39; 427/16; 430/117, 125, 118, 126

[56] References Cited

U.S. PATENT DOCUMENTS

| | | | |
|---|---|---|---|
| 3,793,018 | 2/1974 | Van Engeland | 96/1 R |
| 3,834,909 | 9/1974 | Usui et al. | 96/1 LY |
| 3,849,171 | 11/1974 | Takahashi | 96/1 LY |
| 3,867,170 | 2/1975 | Ferguson et al. | 427/16 X |
| 3,885,960 | 5/1975 | Anderson | 96/1 LY |

*Primary Examiner*—John D. Welsh

*Attorney, Agent, or Firm*—James E. Bryan

[57] ABSTRACT

This invention relates to an improvement in a copying process wherein a latent image produced on a chargeable imaging surface by electrostatic charging and exposure is developed by means of an aqueous ink and transferred onto a receiving material and the imaging surface is then cleaned, the improvement being that the imaging surface has a completely smooth, hydrophobic surface which preferably is not wetted by the aqueous ink applied by means of a known structured applicator element, and the cleaning liquid used to detach residual ink still present after transfer can be easily wiped off and forms a wetting angle of more than 90° with the imaging surface.

The invention also relates to the developer liquid and the cleaning liquid used in the process.

19 Claims, No Drawings

DEVELOPING ELECTROPHOTOGRAPHIC IMAGES USING AQUEOUS INK AND TREATING SMOOTH, HYDROPHOBIC IMAGE SURFACE WITH CLEANING LIQUID

The present invention relates to a process for the production of electrophotographic copies by means of a copying apparatus adapted for cyclic operation, wherein a latent image produced on a chargeable imaging surface by electrostatic charging and exposure is developed with aqueous ink and transferred onto a receiving material and the imaging surface is then cleaned. Further, the invention relates to the developer liquid and the cleaning liquid used in the process.

In electrophotographic copying machines using ordinary paper, photoconductive copying drums or copying webs are used. The charge images produced on the photoconductor layer by electrostatic charging and image-wise exposure are made visible by means of a dry toner or liquid toner, and the toner image is then transferred onto the copying paper.

Dry toners are composed of colored polymer powders. They must be fixed on the copying paper by an energy-consuming fusing step. The term "liquid toners" designates polymer-coated pigment particles dispersed in binder-containing, insulating liquids, preferably in aliphatic hydrocarbons. No energy, or only very little energy, is required to fix them on the copying paper, but considerable quantities of hydrocarbons penetrate into the copying paper in their use and are released into the surrounding air.

Therefore, attempts have been made to use water-based toner liquids which are ecologically harmless. These attempts were successful, to some extent, in the development of latent images on zinc oxide/binder layers (see German Auslegeschriften Nos. 1,219,328, and No. 1,293,593), in particular because of the relatively rough surface structure of such layers.

On smooth photoconductive layers, however, which are normally used in copying machines adapted to cyclic operation, electrostatic charge images are immediately erased by electrically conductive aqueous inks. Therefore, development by contact with such inks is impossible.

Latent charge images on smooth photoconductor layers can be made visible with aqueous inks only if a direct contact between the ink and the photoconductor layer is avoided. This may be effected by one of two known methods. According to the first of these methods, the charge image is covered with a thin layer of an insulating liquid before it is contacted with the aqueous developer, as is disclosed in German Offenlegungsschriften Nos. 1,927,210, and 2,226,479. The applied ink adheres to the areas corresponding to the charge image.

According to the second method, which is known from U.S. Pat. No. 3,084,043, the ink is applied to the charge image from the depressions of a structured applicator element. Only the raised portions of the applicator element, from which the ink had been removed by a wiper, come into contact with the photoconductor layer. Under the influence of the charge image, the electroconductive ink is polarized and migrates from the depressions onto the photoconductor surface. After transfer of the ink from the photoconductor layer to the receiving material, the photoconductor layer must be cleaned and dried, and is then ready for the next copying cycle.

By another cleaning method, disclosed in German Offenlegungsschrift No. 2,061,530, the ink-stained photoconductor layer is treated with a cleaning liquid which is compatible with the ink and is then dried with an absorptive cloth. According to still another method, which is disclosed in German Offenlegungsschrift Nos. 2,052,535, and 2,056,546, the ink-stained photoconductor layer is dusted with an absorptive powder after transfer of the ink-developed image, and the powder is then wiped off with a cloth, together with the traces of ink.

When the photoconductive selenium layers—which are the only layers used in practice for cyclic copying with ink—are cleaned with ink-dissolving aqueous mixtures and then dried with an absorptive cloth, an annoying residue composed of ink and cleaning liquid remains. This residual film weakens the charge of the selenium layer and causes an increased transverse conductivity and, consequently, reduced sharpness of the copies (see German Offenlegungsschrift No. 2,032,652). With an increased intensity of drying, for example when a web of absorptive cloth is used, mechanical damage to the photoconductor layer constantly increases (German Offenlegungsschrift No. 2,032,652). Also, if the photoconductor layer is dusted over with a fine powder and then brushed off, the photoconductor layer is rapidly damaged. Although the copying processes described above generally require a high expenditure on equipment, they nevertheless tend to cause soiling of the copying machines. These deficiencies hitherto have prevented a wider use of cyclic copying with ink.

Thus, it is the object of the present invention to provide a process for the production of electrophotographic copies with aqueous inks in copying machines designed for cyclic operation, the process being without the above-described disadvantages and using a system which comprises a smooth, chargeable imaging surface, especially a photoconductor layer, an aqueous ink, and a cleaning liquid, and by means of which it is possible to completely remove residues of ink and of cleaning liquid during cyclic operation without causing damage to the imaging surface. These conditions are a prerequisite for long runs.

In order to achieve this object, use is made of a copying process wherein a latent image produced on a chargeable imaging surface by electrostatic charging and exposure is developed with aqueous ink and then transferred onto a receiving material and the imaging surface is then cleaned. In the process according to the present invention the imaging surface has a completely smooth hydrophobic surface which preferably is not wetted by the aqueous ink applied from a known structured applicator element, and the cleaning liquid used to detach the residual ink still present after transfer can be easily wiped off and forms a wetting angle of more than 90° with the imaging surface.

Photoconductor layers are particularly suitable as chargeable imaging surfaces. According to the present invention, organic photoconductors are used. Surfaces to which charge images are applied, e.g. by imagewise charging or by transfer of a charge image, are also designated as chargeable imaging surfaces.

The organic photoconductor layers used according to the invention must be more strongly hydrophobic, i.e. less easily wettable by aqueous inks, than the hitherto used selenium layers. The hydrophobic properties of a layer may be easily ascertained by comparative wetting tests, using liquids with different surface tensions.

Virtually all known organic photoconductor layers on a conductive support may be used. Preferably, an imaging surface is used which contains or consists of poly-N-vinyl carbazole and trinitrofluorenone. An imaging surface which contains a condensation product of 3-bromopyrene and formaldehyde also has proved advantageous. Alternatively, the chargeable imaging surface may be in the form of a photoconductive double layer, comprising a charge carrier-producing layer with a hydrophobic charge carrier-transporting layer coated thereon, as is disclosed, e.g., in German Offenlegungsschrift No. 2,237,539.

Photoconductor films provided with a very smooth hydrophobic protective layer, as described, e.g., in German Offenlegungsschrift No. 2,452,623, may be used with particular advantage.

The photoconductor layer is employed in the normal manner as the chargeable imaging surface in the copying machine, e.g. in the form of a cover on a seamless drum, or as a flexible web. Flexible photoconductor materials may be stretched over or cemented on a copying drum or used in the form of endless belts.

Suitable aqueous inks are aqueous dye solutions containing at least one dye, or aqueous pigment dispersions which are easily detached by a cleaning liquid by which the photoconductive layer is not wetted and which, in concentrations below about 0.15% by weight, do not diminish the surface tension of the cleaning liquid to such an extent that the hydrophobic chargeable imaging surface is wetted. Combinations of dye solutions and pigment dispersions also may be used, for example. It is possible, according to the invention, for the aqueous ink to wet the imaging surface, but preferably an ink is used which does not wet the imaging surface.

Provided the ink does not wet the imaging surface, it is possible to use the same solution as the aqueous ink and as the cleaning liquid. In this case, the troughs for the aqueous ink and for the cleaning liquid provided in the copying machine may be connected with each other. In this manner, it is possible to avoid an undesirable concentration of the dye or pigment in the cleaning station, if the evaporation losses occurring during copying are compensated by adding fresh solvent, e.g. fresh water, to the cleaning liquid. The solution can be used only as the cleaning liquid, however, if it does not tend to foam in the cleaning station. In the cleaning station, the cleaning liquid is normally applied to the soiled photoconductor layer by means of a rotating foam roller. The foaming tendency may be reduced or eliminated in known manner by adding an anti-foaming agent.

As a rule, aqueous dye solutions meet the requirements better than do aqueous pigment dispersions containing wetting-promoting dispersing agents. Therefore, it is preferred to use an aqueous solution containing at least one dye. The following specific black and blue dyes, whose names in some cases are registered trademarks, may be used with particular success: Paper Deep Black AGX, a product of Bayer AG., Ink Blue BITN (Color Index No. 42,780), Supranol Blue B (C.I. No. 42,645), AstraViolet 3 R extra (C.I. No. 49,013), and Benzo Deep Black E (C.I. No. 30,235) and Patent Blue AE (C.I. No. 42,090).

Alternatively, it is also possible to use aqueous dispersions of, e.g., carbon black or organic pigments under the conditions of the present invention, but the surface tension of the cleaning liquid is relatively quickly reduced, e.g. by the dispersing agent, so that the cleaning liquid must be frequently replaced by fresh liquid.

The quantity of the dye or dye mixture present may vary within wide limits. It was found, however, that a concentration above 15% by weight, calculated on the total weight of the aqueous dye to be used, brings no further advantages. Solutions containing from about 0.5 to about 10 percent by weight of dye are normally used according to the invention.

The pigment may be present in a quantity between about 1 and 40 percent by weight, based on the total weight of the developer.

A pigment in an aqueous dispersion which has proved particularly advantageous is, e.g., "Hostatint"(R) Black 6 R, a pigment paste without a binder, produced by Hoechst Aktiengesellschaft.

The quantity of dye which may be added to the aqueous dispersion, if desired, may vary within wide limits. As a rule, no further advantage is achieved by adding more than 5 percent by weight, calculated on the total weight of the developer to be used. Preferably, about 0.5 to about 5 percent by weight are added.

Suitable dyestuffs of good water solubility are found among various classes of dyes, e.g. among acid, basic, directly absorbed and reactive dyestuffs. Substantive dyes have the advantage that they are directly absorbed by the cellulose fibers of the copying paper and thus are fixed thereon. If it is desired to produce water-resistant copies, it is frequently possible to convert the dyes into sparingly soluble salts in the copying paper. In this case, the paper must contain the fixing component. According to another fixing method, binders may be added which become insoluble in the copying paper. For example, it is possible to use acid resins and polymers dissolved in water to which volatile bases have been added. The pH value of these aqueous inks must be sufficiently high that any ink dried in the copying machine may be redissolved in fresh ink.

Generally, water-soluble binders, thickeners, humectants etc. may be added to the aqueous inks, in known manner.

By varying their concentration or by adding thickeners, e.g., the viscosity of the aqueous inks may be adapted to the tool by which they are applied. Of the known applicator elements each element requires a specific viscosity. Suitable applicator elements, e.g., are rollers or endless belts provided with tiny cups, grooves or knobs, or belts or drum covers made of a monofilament fabric.

After having been filled with the aqueous ink, the applicator element is thoroughly wiped off, so that the raised areas are free from liquid when they are contacted with the surface carrying the charge image. Suitable wipers are, e.g., mechanical devices such as elastic doctor blades or doctor rolls, and also air brushes.

In order to ensure uniform development, either the photoconductor material or the applicator element, or both, must be elastic. Preferably, endless flexible photoconductor belts supported on rubber rollers are used in combination with rigid applicator elements, e.g. applicator rolls.

The cleaning liquid used for removing traces of aqueous ink remaining on the imaging surface, e.g. the photoconductor layer, after transfer of the developed image to the receiving material, e.g. paper, does not wet the imaging surface according to the invention. It detaches, however, slightly dried or still wet ink that had not been transferred.

For most aqueous inks, water is best suited and is thus preferred according to the invention. Desalted water is more advantageous than ordinary water, because, among other advantages, chalk stains are thus avoided. In the case of aqueous inks containing acid binders, it may be of advantage to add to the cleaning liquid a weak base, e.g. diluted ammonia solution or sodium carbonate solution. The concentration of the base must be sufficiently low that no wetting of the imaging surface occurs.

The cleaning liquid may contain organic liquids which only slightly reduce the surface tension, e.g. formamide or triethylene glycol. Care must be taken, however, that the organic additives do not attack the imaging surface.

The cleaning liquid may be applied to the soiled imaging surface in any desired manner. Advantageously, rotating rollers covered with soft sponge rubber may be used. By using the water-filled soft rubber rollers, traces of ink may be wiped off without damaging the imaging surface in an undesirable manner.

A simple, sharp-edged doctor blade made of rubber or rubber-like materials suffices for removing the drops of cleaning liquid present on the cleaned imaging surface. Various elastomers may be used for this purpose, e.g. polyurethanes or polychloroprenes. The doctor blade may be mounted in a fixed position or oscillate transversely to the web; alternatively, it may be in the form of a revolving endless belt. An even gentler wiping is possible by using an air brush.

In order to remove the last traces of humidity, the cleaned imaging surface may be after-dried in known manner with cold or, preferably, warm air before the next cycle begins; this is particularly advisable in the case of high feed speeds of the web, of about 10 m/min. or more. In a copying machine having an endless photoconductor web installed therein, it is also possible to form a relatively wide loop in a well ventilated zone. During passage of this loop, the last traces of humidity escape from the web.

The inventive system comprising a completely smooth hydrophobic imaging surface with a preferably organic photoconductor, readily soluble aqueous inks, cleaning liquids, which do not wet the imaging surface, and gentle wipers for cleaning, ensures a gentle, but satisfactory cleaning of the copying layer. After completion of the copying cycle, so little humidity remains on the layer that the next cycle is not appreciably affected. Long runs may be printed before the photoconductor shows any signs of damage.

No annoying or physiologically hazardous gases escape from the copying machine during the copying operation, and the copies produced are odorless. The aqueous inks used can be produced much more easily than the conventionally employed dry or liquid electrophotographic toners.

The following examples describe preferred materials, methods and techniques of the present invention, but it is not intended to restrict the invention to these materials methods and techniques.

EXAMPLES

As a rule, an electrophotographic copying machine comprising a revolving endless photoconductor web was used for the tests. The stations used for electrostatic charging, imagewise exposure, development, transfer, and cleaning were arranged, in this order, about the web.

The developing station included an applicator roller, i.e. a brass roller of 8 cm diameter to which a film provided with screen-like elevations had been cemented. The screened film was produced as follows:

A 25 μ thick, negative-working dry resist film marketed by Kalle Niederlassung der Hoechst AG under the designation "T 25" was laminated in a laminator to the aluminum surface of a 100 μm thick polyester film provided on one side with a vapor-deposited aluminum layer. Then, the material was exposed under a smooth point screen with 60 points per centimeter and a tonal value of 85% and was then completely developed with 0.8% by weight sodium carbonate solution. The aluminum surface under the non-exposed areas was thereby bared.

During operation, the photoconductor web and the surface of the applicator roller moved at the same speed of about 10 m/min. and in the same direction. The aqueous ink used in each case was taken from a trough by a system composed of two rubber rollers and applied to the applicator roll. The applicator roll was doctored off by means of an air brush. The cleaning station included a soft foam roller which rotated during operation and dipped briefly into water with its lower portion, while its upper portion was in light contact with the photoconductor web. Immediately following the foam roller, a doctor blade was fixedly mounted which consisted of polyurethane of a Shore hardness of 65°.

EXAMPLES 1 to 12

| | | Aqueous Ink | | |
|---|---|---|---|---|
| Ex. No. | Photo-con-ductor | Percent by weight | Dye or Pigment | Cleaning Liquid |
| 1 | I | 2 | Ink Blue BITN (C.I. 42,780) | $H_2O$ |
| 2 | II | 6 | Ink Blue BITN (C.I. 42,780) | " |
| 3 | III | 4 | Ink Blue BITN (C.I. 42,780) | " |
| 4 | IV | 5 | Ink Blue BITN (C.I. 42,780) | " |
| 5 | II | 4 | Ink Blue BITN (C.I. 42,780) | aqueous dye |
| 6 | II | 3.5 | Paper Deep Black AGX (Bayer) | $H_2O$ |
| 7 | II | 3.5 | Paper Deep Black AGX (Bayer) | aqueous dye + 0.01% anti-foaming agent[1] |
| 8 | IV | 4 | Supranol Blue B (C.I. 42,645) | $H_2O$ |
| 9 | IV | 3.5 | Astra Violet 3 R extra (C.I. 48,013) | " |
| 10 | II | 5 | Patent Blue AE (C.I. 42,090) | " |
| 11 | II | 5 | Benzo Deep Black E (C.I. 30,235) | " |
| 12 | II | 2 | Paper Deep Black AGX | " |
| | | +10 | Hostatint Black GR[2] | |

The following photoconductors were used for the chargeable imaging surface in the Examples:

I. A layer of poly-N-vinyl carbazole and trinitrofluorenone, as disclosed in German Auslegeschrift No. 1,572,347;

II. a layer of poly-N-vinyl carbazole and trinitrofluorenone covered with a nitrocellulose top layer, as disclosed in German Offenlegungsschrift No. 2,452,623;

III. a layer containing a condensation product of 3-bromopyrene and formaldehyde, as disclosed in German Offenlegungsschrift No. 2,137,288; and IV. a photoconductive double layer as disclosed in German Offenlegungsschrift No. 2,237,539, comprising an N,N'-dimethyl-perylene-3,4,9,10-tetracarboxylic acid diimide layer coated with a layer composed of 2 parts by weight of 2,5-bis-(p-diethylaminophenyl)-oxadiazole-1,3,4, 1 part by weight of a vinyl acetate/vinyl chloride copolymer, and 1 part by weight of polyester.

1. The anti-foaming agent used was Nopco NDW, a product of Nopco Chemical Co., USA.

2. A binder-free pigment paste marketed by Hoechst AG.

It will be obvious to those skilled in the art that many modifications may be made within the scope of the present invention without departing from the spirit thereof, and the invention includes all such modifications.

What is claimed is:

1. In a copying process wherein a latent image produced by electrostatic charging and exposure on a chargeable imaging surface containing at least one organic photoconductor is developed by means of an aqueous ink and transferred onto a receiving material and the imaging surface is then cleaned, the improvement comprising that (a) said imaging surface has a completely smooth, hydrophobic surface to which the aqueous ink is applied by means of a known structured applicator element, (b) said aqueous ink applied to said imaging surface does not wet said surface and (c) using a cleaning liquid to detach residual ink still present after transfer, said cleaning liquid being easily wiped off by a simple, sharp-edged doctor blade or by use of an air brush and forming a wetting angle of more than 90° with said imaging surface.

2. A process according to claim 1 in which the imaging surface contains polyvinyl carbazole and trinitrofluorenone.

3. A process according to claim 1 in which the imaging surface contains a condensation product of 3-bromopyrene and formaldehyde.

4. A process according to claim 1 in which the imaging surface is a photoconductive double layer composed of a charge carrier-producing layer and a charge carrier-transporting layer.

5. A process according to claim 1 in which the imaging surface is an organic photoconductor layer covered by a hydrophobic protective layer.

6. A process according to claim 1 in which the chargeable imaging surface is flexible.

7. A process according to claim 1 in which the aqueous ink is an aqueous solution of at least one dye.

8. A process according to claim 1 in which the aqueous ink is an aqueous dispersion of a pigment.

9. A process according to claim 8, in which the aqueous pigment dispersion contains at least one water-soluble dye.

10. A process according to claim 1 in which the aqueous ink is readily detached by the cleaning liquid.

11. A process according to claim 9 in which the aqueous ink is a solution of Paper Deep Black AGX.

12. A process according to claim 1 including adjusting the viscosity of the aqueous ink by changing its concentration.

13. A process according to claim 1 including adapting the viscosity to the applicator by adding a thickener.

14. A process according to claim 1 in which the cleaning liquid is desalted water.

15. A process according to claim 1 in which the cleaning liquid is desalted water and a weak base.

16. A process according to claim 1 in which the cleaning liquid used additionally contains an organic liquid by which its surface tension is only slightly reduced.

17. A process according to claim 16 in which the organic liquid is formamide.

18. A process according to claim 1 in which the cleaning liquid is a non-wetting liquid ink which is also used as the aqueous ink.

19. A process according to claim 18 including an anti-foaming agent added to the aqueous ink.

* * * * *